US010288251B2

(12) United States Patent
Mestre et al.

(10) Patent No.: US 10,288,251 B2
(45) Date of Patent: May 14, 2019

(54) MOTOR VEHICLE LIGHTING DEVICE COMPRISING LIGHT MODULES COOLED BY MEANS OF A GENERATOR OF AN AIR FLOW

(71) Applicant: VALEO VISION, Bobigny (FR)

(72) Inventors: Hugo Mestre, Paris (FR); Rafael Martinez, Martos (ES); Isidro Garcia, Jaen (ES); Pedro Zambrana, Martos (ES)

(73) Assignee: VALEO VISION, Bobigny (FR)

( * ) Notice: Subject to any disclaimer, the term of this patent is extended or adjusted under 35 U.S.C. 154(b) by 63 days.

(21) Appl. No.: 15/446,106

(22) Filed: Mar. 1, 2017

(65) Prior Publication Data

US 2017/0254501 A1 Sep. 7, 2017

(30) Foreign Application Priority Data

Mar. 2, 2016 (FR) ..... 16 51749

(51) Int. Cl.
*F21S 45/47* (2018.01)
*F21S 45/49* (2018.01)
(Continued)

(52) U.S. Cl.
CPC ..... *F21S 45/47* (2018.01); *F21S 41/14* (2018.01); *F21S 45/43* (2018.01); *F21S 45/49* (2018.01); *F21V 29/673* (2015.01); *F21V 29/763* (2015.01); *F21V 29/83* (2015.01); *F21S 41/141* (2018.01); *F21S 43/14* (2018.01);
(Continued)

(58) Field of Classification Search
CPC .. F21S 41/14; F21S 45/42; F21S 45/43; F21S 45/47; F21S 45/49; F21S 41/141; F21S 43/14; F21V 29/673; F21V 29/83
See application file for complete search history.

(56) References Cited

U.S. PATENT DOCUMENTS

2007/0091632 A1 4/2007 Glovatsky et al.
2011/0051453 A1* 3/2011 Nagasawa ..... B60Q 1/007 362/547
2011/0308770 A1* 12/2011 Cho ..... F21S 45/43 165/104.11

FOREIGN PATENT DOCUMENTS

DE 10 2007 043 961 A1 3/2009
DE 10 2012 205 434 A1 10/2013
(Continued)

OTHER PUBLICATIONS

Betz et al, Mar. 19, 2009, "Description DE102007043961", Patent Translate Powered by EPO and Google, pp. 1-30.*
(Continued)

*Primary Examiner* — Alan B Cariaso
(74) *Attorney, Agent, or Firm* — Oblon, McClelland, Maier & Neustadt, L.L.P.

(57) ABSTRACT

A motor vehicle lighting device includes structural elements with a housing, at least one light module accommodated inside the housing, and at least one light source cooperating with an optical surface. The light module is provided with a heat sink, a generator of an air flow, and a single air duct suitable for cooperating with the generator of the air flow such as to direct the generated air flow towards the heat sink of the at least one light module. The air duct is formed by an open part added in the housing, and at least one closing structural element suitable for closing all or part of the added part.

12 Claims, 6 Drawing Sheets

(51) Int. Cl.

| | |
|---|---|
| ***F21V 29/83*** | (2015.01) |
| ***F21V 29/67*** | (2015.01) |
| ***F21S 41/14*** | (2018.01) |
| ***F21V 29/76*** | (2015.01) |
| ***F21S 45/43*** | (2018.01) |
| *F21Y 115/00* | (2016.01) |
| *F21Y 115/10* | (2016.01) |
| *F21S 41/141* | (2018.01) |
| *F21S 43/14* | (2018.01) |
| *F21W 102/00* | (2018.01) |

(52) U.S. Cl.
CPC ..... *F21W 2102/00* (2018.01); *F21Y 2115/00* (2016.08); *F21Y 2115/10* (2016.08)

(56) References Cited

FOREIGN PATENT DOCUMENTS

| | | |
|---|---|---|
| EP | 2 607 784 A1 | 6/2013 |
| FR | 2 946 730 A1 | 12/2010 |
| FR | 2 997 751 A1 | 5/2014 |

OTHER PUBLICATIONS

Jauernig et al, Jun. 26, 2013, "Description EP2607784", Patent Translate Powered by EPO and Google, pp. 1-17.*
French Preliminary Search Report dated Nov. 11, 2016 in Patent Application No. FR 1651749 (with English translation of Categories of Cited Documents).

* cited by examiner

MOTOR VEHICLE LIGHTING DEVICE COMPRISING LIGHT MODULES COOLED BY MEANS OF A GENERATOR OF AN AIR FLOW

TECHNICAL FIELD OF THE INVENTION

The present invention relates to a motor vehicle lighting device.

It has a specific, but not limiting, use in lighting devices, such as motor vehicle headlights.

TECHNOLOGICAL BACKGROUND OF THE INVENTION

A motor vehicle lighting device, such as a headlight, comprises, in a manner known to a person skilled in the art:

- a plurality of light modules accommodated inside a housing, comprising at least one light source cooperating with an optical system, said light modules each being provided with a heat sink;
- a generator of an air flow;
- at least one air duct suitable for cooperating with said generator of the air flow such as to direct said generated air flow towards the heat sink of a light module.

An air duct is a piece that is entirely added in the housing. It is installed by an operator between the air flow generator and a heat sink. As many ducts are provided as light modules to be cooled.

A disadvantage of this prior art is that the number of air ducts is dependent upon the number of light modules to be cooled. This results in a large spatial requirement for the ducts in the lighting device and substantial costs for manufacturing this lighting device.

In this context, the aim of the present invention is to solve the aforementioned disadvantages.

GENERAL DESCRIPTION OF THE INVENTION

To this end, the invention proposes a lighting device for motor vehicle, said lighting device comprising:

- structural elements including a housing;
- at least one light module accommodated inside said housing, comprising at least one light source cooperating with an optical system, said light module being provided with a heat sink;
- at least one generator of an air flow; and
- at least a single air duct suitable for cooperating with said generator of the air flow such as to direct said generated air flow towards the heat sink of said at least one light module, said air duct being formed by:
- an open part added in the housing; and
- at least one closing structural element suitable for closing all or part of said added open part.

Thus, as will be seen in detail hereafter, by using a duct forming a single assembly, the spatial requirement of this assembly in the lighting device is limited. Furthermore, the duct is formed by an open part external to the lighting device and added therein and by a closing structural element internal to the lighting device. The internal structural element is thus suitable for receiving the external open part of the duct. The manufacture of this duct is therefore more economical since an element thereof already pre-exists in the lighting device. The costs of manufacturing this lighting device are then reduced.

According to non-limiting embodiments, the lighting device can further include one or more additional features from the following:

In a non-limiting embodiment, the closing structural element is an optical unit arranged in said housing and suitable for receiving said at least one light module.

In a non-limiting embodiment, the closing structural element is said housing.

In a non-limiting embodiment, the added part of the air duct is fixed by fixing means to the closing structural element.

In a non-limiting embodiment, the fixing means are latching means or sticking means or screwing means.

In a non-limiting embodiment, the generator of the air flow includes an air outlet and the air duct is connected directly to this air outlet.

In a non-limiting embodiment, the air duct extends in the lighting device from the air flow generator and in a substantially longitudinal direction.

In a non-limiting embodiment, the lighting device comprises a series of N light modules wherein the air duct is divided into N air sub-ducts, each sub-duct supplying a light module of the series of the N light modules, respectively, with air.

In a non-limiting embodiment, the air duct includes at least one outlet which opens directly onto the heat sink of said at least one light module.

In a non-limiting embodiment, said outlet of the air duct has a closed section, in other words a closed profile.

In a non-limiting embodiment, the air sub-duct which supplies the light module furthest from the air flow generator with air includes an outlet which is closed directly by the housing.

In a non-limiting embodiment, the outlet of said air sub-duct is divided into a plurality of channels.

In a non-limiting embodiment, the light source is a semi-conducting emitting chip.

In a non-limiting embodiment, the structural element forming part of the air duct is made from plastic.

In a non-limiting embodiment, the lighting device is a headlight.

BRIEF DESCRIPTION OF THE FIGURES

The invention and the various uses thereof will be better understood upon reading the following description and examining the figures appended thereto.

DESCRIPTION OF EMBODIMENTS OF THE INVENTION

Figure 1:
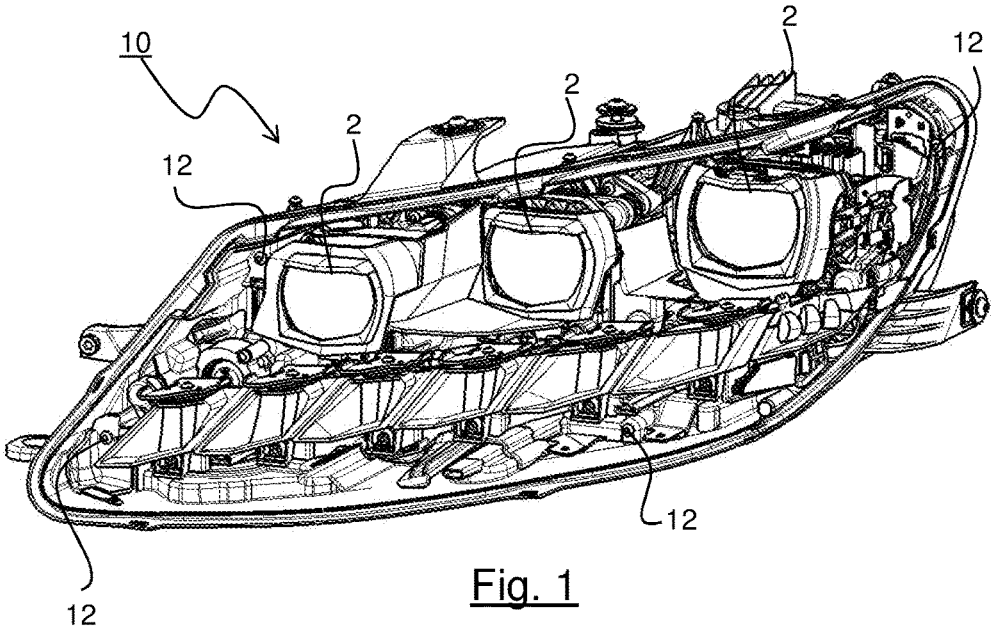
FIG. 1 shows a motor vehicle lighting device comprising a plurality of light modules according to a non-limiting embodiment of the invention.

The elements that are identical, by structure or by function, appearing on various figures retain, unless otherwise specified, the same references.

The motor vehicle lighting device 10 according to the invention is described with reference to FIGS. 1-11.

Motor vehicle means any type of motorized vehicle.

In a non-limiting example taken in the remainder of the description, the lighting device 10 is a headlight.

The lighting device 10 comprises:

structural elements 1, 11 including a housing 1;

at least one light module 2 accommodated inside said housing 1;

a generator of an air flow 5; and a single air duct 7 suitable for cooperating with said generator of the air flow 5.

In a non-limiting embodiment, the lighting device 10 comprises a plurality of light modules 2. In the non-limiting example illustrated, the lighting device 10 comprises three light modules 2.

A light module 2 comprises:

at least one light source (not illustrated) cooperating with an optical surface and;

an optical surface (not illustrated). In a non-limiting embodiment, the optical surface is a reflector and/or a lens.

The light modules 2 are suitable for emitting a light beam in order to produce at least one photometric function.

In non-limiting embodiments, the photometric function is:

a so-called "low beam" function in order to produce a low-beam headlamp.

a so-called "high beam" function in order to produce a high-beam headlamp.

a so-called "fog" function in order to produce a fog lamp.

a so-called DRL ("Daytime Running Lamp") function in order to produce a daytime running lamp.

In a non-limiting embodiment, the light source is a semiconducting emitting chip.

In a non-limiting alternative embodiment, a semiconducting emitting chip is part of an electro-luminescent diode. Electro-luminescent diode means any type of electro-luminescent diodes, whether in non-limiting examples of the LEDs ("Light-Emitting Diode"), OLEDs ("organic LED"), AMOLEDs (Active-Matrix Organic LED), or FOLED (Flexible OLED).

The light modules 2 are accommodated in the lighting device 10 by means of structural elements 1, 11. Among these structural elements, it is possible to see a housing 1 (illustrated in FIG. 2) and an optical unit 11 (illustrated in FIG. 3) accommodated in the housing 1.

Figure 2:
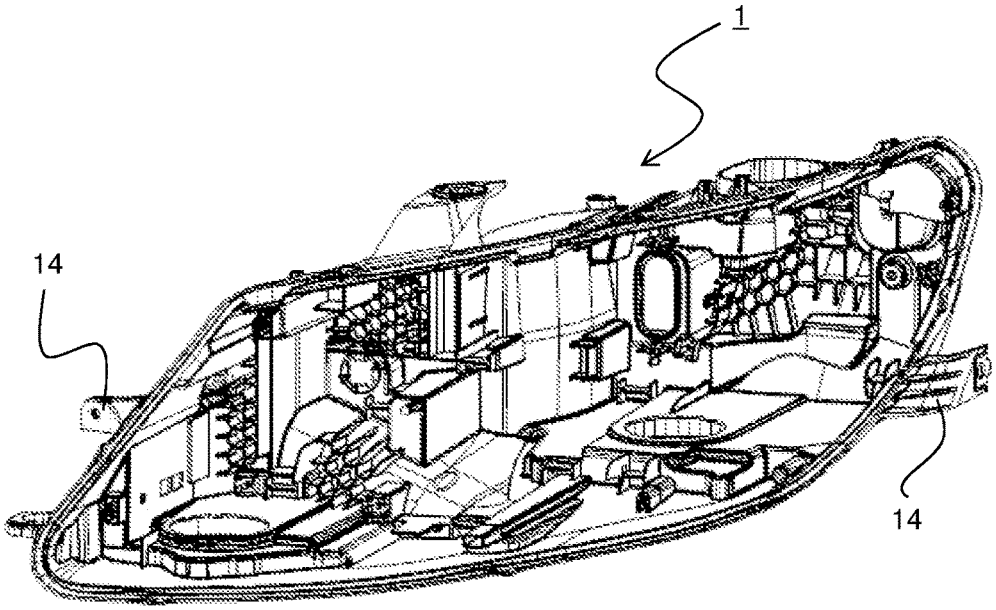
FIG. 2 shows a first structural element of the housing lighting device, said housing being suitable to be fixed in the motor vehicle.

FIG. 2 shows, in greater detail, the housing 1 of the lighting device 10. This housing 1 is in the general shape of a shell defining an inner volume in which the light modules 2 are accommodated.

The housing 1 also has fixing clamps 14 for the fixing thereof in the motor vehicle by means of fixing screws (not shown in FIG. 2).

The housing 1 is suitable for receiving an optical unit 11. In a non-limiting embodiment, the optical unit 11 is fixed in the housing by means of four fixing screws 12 as is illustrated in FIG. 1.

Figure 3:
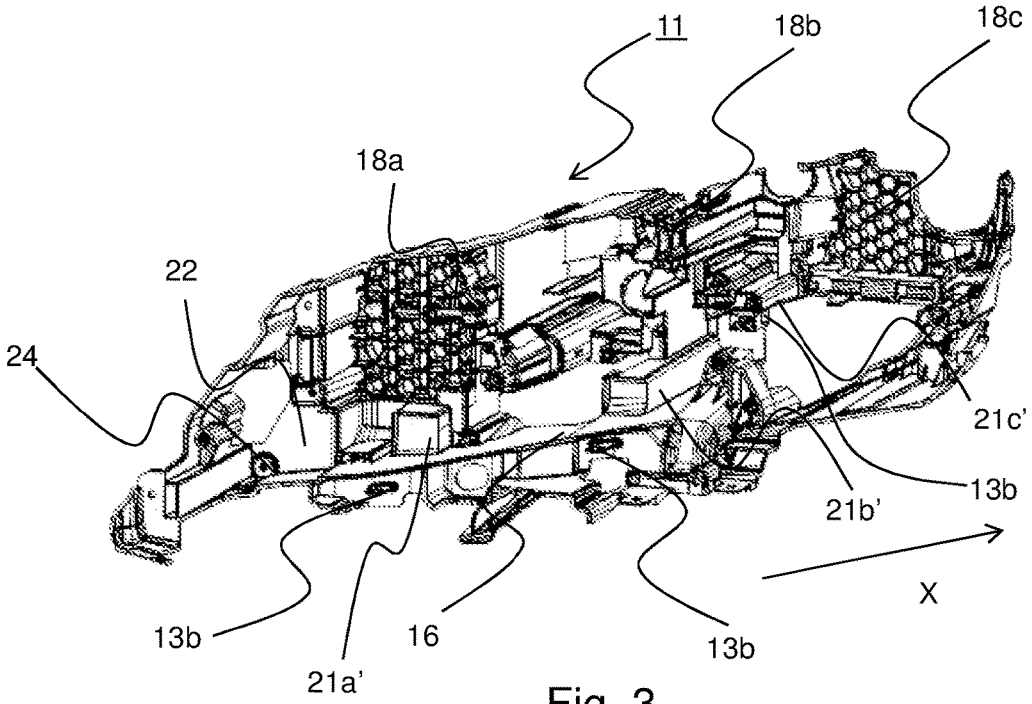
FIG. 3 shows an optical unit of the lighting device, this optical unit being suitable for being accommodated in the housing.

FIG. 3 shows the optical unit 11 suitable for being accommodated in the housing 1.

In a non-limiting embodiment, the optical unit 11 is made from plastic.

In particular, it includes a ramp 16. This ramp 16 is in the form of an elongated element that is generally planar and slightly inclined. The ramp 16 extends in a direction X longitudinal with respect to the optical unit 11.

The optical unit 11 also comprises parts 21*a*′, 21*b*′, 21*c*. The ramp 16 and the parts 21*a*′, 21*b*′, 21*c* are suitable for receiving an open part 9 of an air duct 7, which part is added in the housing 1. This added open part 9 rests on the ramp 16 on which it is hooked. The added open part 9 is therefore closed by the optical unit 11, namely the ramp 16 and the parts 21*a*′, 21*b*′, 21*c* of the optical unit 11.

Figure 4:
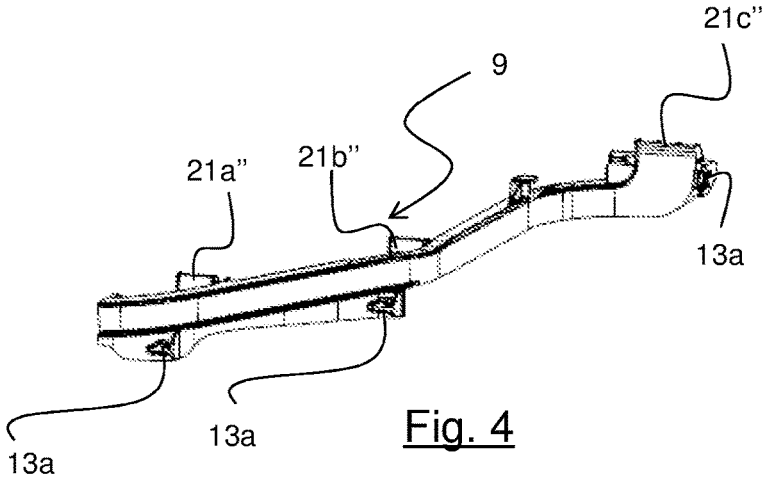
FIG. 4 shows an added open part of an air duct of the lighting device of FIG. 1, which part is suitable for being closed by at least one structural element of this lighting device.

The added open part 9 is illustrated in FIG. 4. In this FIG. 4, the added open part 9 is in the form of an elongated part complementary to the ramp 16 and to the parts 21*a*′, 21*b*′, 21*c*′ of the optical unit 11 such as to form a single air duct 7. The single air duct 7 is thus formed by:

an added open part 9 added in the housing 1; and at least one closing structural element 1, 11, suitable for closing all or part of said added part 9.

In a non-limiting embodiment illustrated in FIG. 3, the closing structural element is the optical unit 11. In this case, the optical unit 11 is suitable for closing all of the added open part 9.

The air duct 7 is suitable for cooperating with an air flow generator 5 and at least one heat sink such as to allow the transfer of the air flow from this air flow generator 5 to the heat sink.

Figure 5:
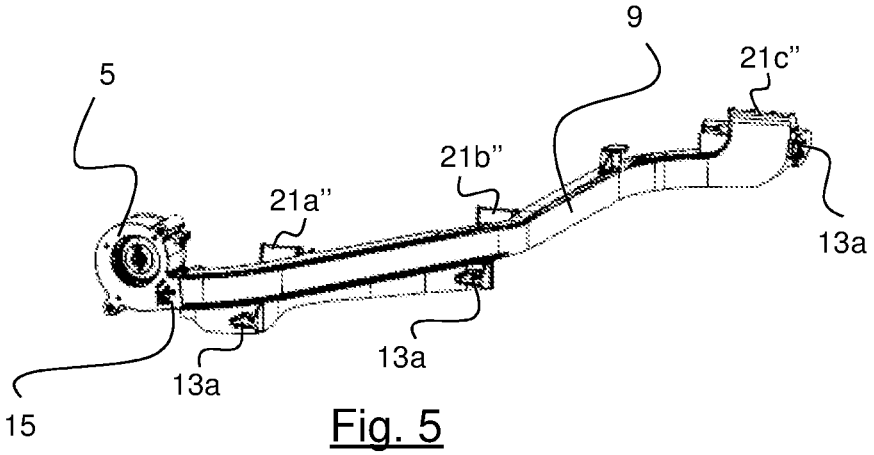
FIG. 5 shows the added open part of the air duct of FIG. 4 which cooperates with an air flow generator.

FIG. 5 illustrates the added open part 9 of the air duct 7 which cooperates with the air flow generator 5. "Air flow generator" means a fan suitable for agitating a certain volume of air with the purpose of forcing this volume of air to pass into the air duct 7.

In the non-limiting embodiment illustrated in FIG. 5, the air flow generator 5 includes an air outlet 15 and the air duct 7 is connected directly to this air outlet 15. Thus, there is no pressure drop between the air flow generator 5 and the air duct 7.

It will be noted that the air flow generator 5 is, in this case, fixed by fixing screws 20 (illustrated in FIG. 9) on a complementary structural element 22, visible in FIG. 3. This complementary structural element 22 comprises, in particular, a fixing opening 24 for receiving one of the fixing screws 20 for the air flow generator 5.

Figure 6:
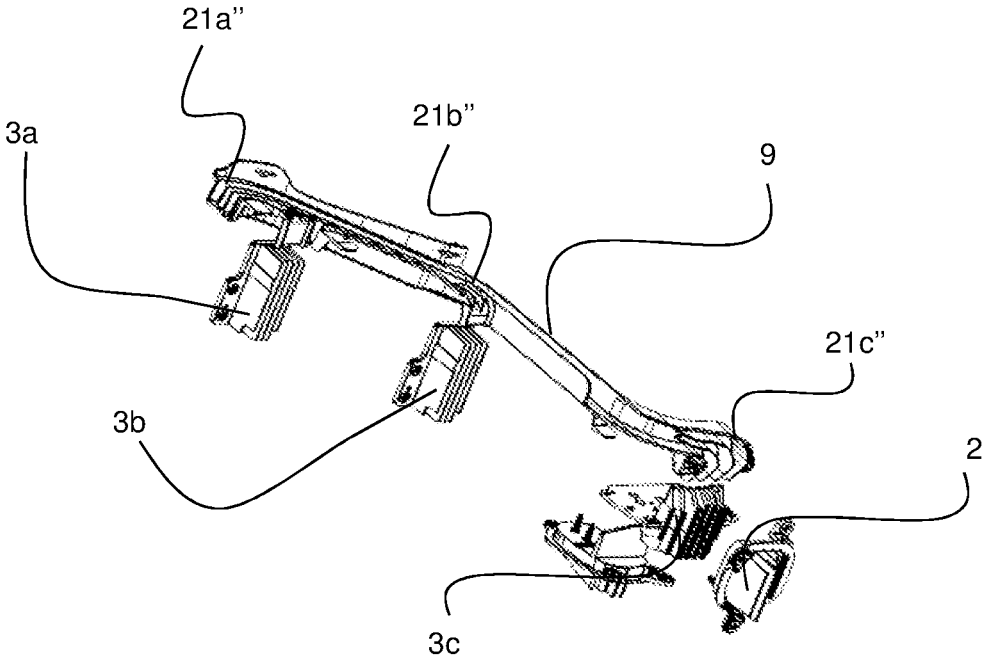
FIG. 6 shows a bottom view of the added open part of the air duct of FIG. 4 which cooperates with a plurality of heat sinks.

FIG. 6 illustrates the added open part 9 of the air duct 7. This added open part 9 is, in this case, open on a lower area which will cooperate with the ramp 16 of the optical unit 11. The added open part 9 is also open on side areas 21*a*″, 21*b*″, 21*c*″ which will cooperate with parts 21*a*′, 21*b*′, 21*c* of the optical unit 11 such as to form outlets 21*a*, 21*b*, 21*c* of the air duct 7.

The air duct 7 is connected to three heat sinks 3*a*, 3*b*, 3*c*. Each heat sink 3*a*, 3*b*, 3*c* is associated with a light module 2. Each heat sink is thus suitable for evacuating the heat given off when this light module 2 operates. For this purpose, each heat sink 3*a*, 3*b*, 3*c* comprises fins allowing a heat exchange with the air flow generated by the air flow generator 15. The air flow sweeps the fins while being forced past, which allows optimum cooling of the sinks 3*a*, 3*b*, 3*c*.

Figure 7:
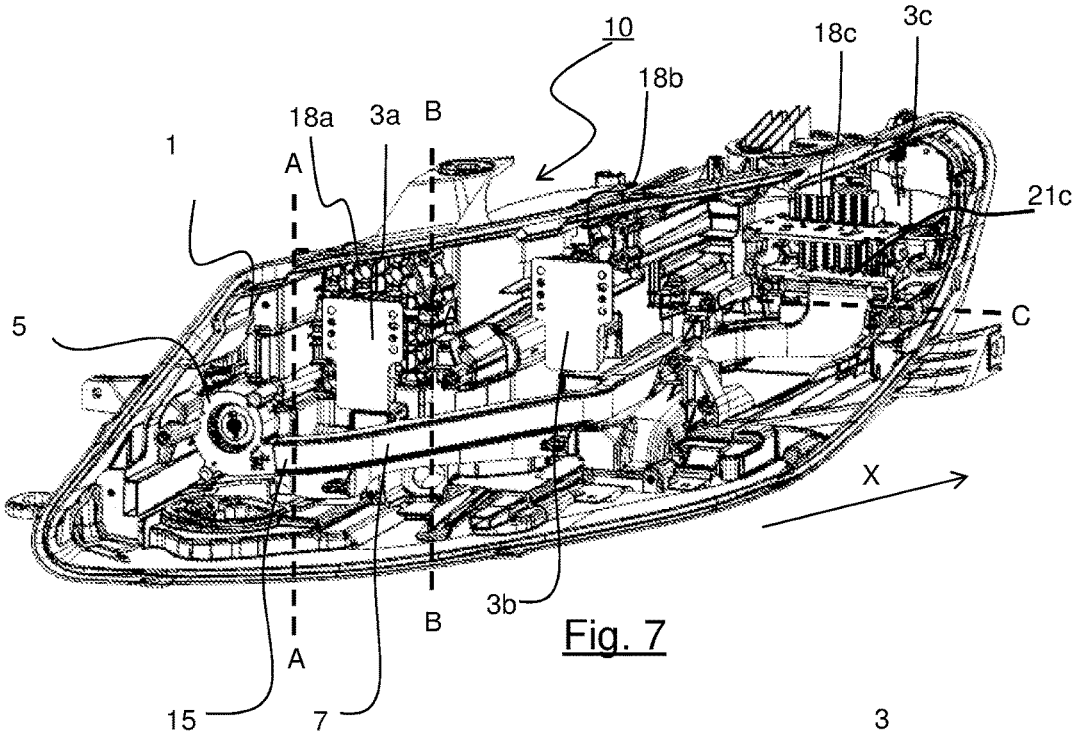
FIG. 7 illustrates the added open part of the air duct of FIGS. 4-6, which duct is accommodated in an optical unit of FIG. 3, the assembly being integrated in the housing of FIG. 2.

It will also be noted that the heat sinks 3*a*, 3*b*, 3*c* are suitable for being fixed on alveolated parts 18*a*, 18*b*, 18*c* of the optical unit 11, as is illustrated in FIGS. 3, 7. These alveolated parts 18*a*, 18*b*, 18*c* allow the structure of the optical unit 11 to be reinforced. In a non-limiting embodiment, these alveolated parts 18*a*, 18*b*, 18*c* are made from plastic. In a non-limiting example, the plastic is polypropylene with 20% glass fiber (known under the reference PP-GF20).

In a non-limiting embodiment, the added open part 9 comprises fixing means suitable for fixing it to a closing structural element, in this case the optical unit 11.

In a non-limiting alternative embodiment, the fixing means comprise first fixing means 13*a* (illustrated in FIG. 4) which are complementary to second fixing means 13*b* (illustrated in FIG. 3) which are part of the ramp 16 of the optical unit 11. The first fixing means 13*a* are, in this case, present in the form of notches and the second fixing means 13*b* are, in a non-limiting embodiment, elastically deformable members. In a non-limiting embodiment, the second fixing means 13*b* are latching means suitable for being inserted into said notches 13*a*. In a non-limiting example, these latching means 13*b* are, in this case, clips.

The air duct 7 is assembled using the following assembly method:

- the added open part 9 is positioned on the ramp 16 such as to position the notches 13*a* opposite the clips 13*b*.
- in this position, a force perpendicular to the transverse direction X is applied on the added open part 9 such that the clips 13*b* are accommodated in the notches 13*a*.

The added open part 9 is thus fixed to the ramp 16 and the air duct 7 is formed.

In another non-limiting embodiment, the fixing means are sticking means.

In another non-limiting embodiment, the fixing means are screwing means.

FIG. 7 illustrates a lighting device 10 in which the air duct 7 is integrated. This air duct 7 is connected directly to the air outlet 15 of the generator of the air flow 5.

In a non-limiting embodiment, the air duct 7 includes at least one outlet which opens directly onto the heat sink of a light module 2. In a non-limiting embodiment, said at least one outlet of the air duct 7 has a closed section. The section is formed by the added open part of the air duct 7 (and particularly an open side area 21*a*″, 21*b*″, 21*c*″) and the closing structural element, in this case the optical unit 11 (and particularly a part 21*a*′, 21*b*′, 21*c*').

In the non-limiting example illustrated in FIG. 7, the air duct 7 includes three outlets 21*a*, 21*b*, 21*c* which open directly onto three heat sinks 3*a*, 3*b*, 3*c*.

In a non-limiting embodiment, the lighting device 10 comprises a series of N light modules 2, in this case three modules in the non-limiting example illustrated, and the air duct 7 is divided into N air sub-ducts 17*a*, 17*b*, 17*c*, each sub-duct supplying a light module 2 of the series of the N light modules, respectively, with air.

Figure 8:
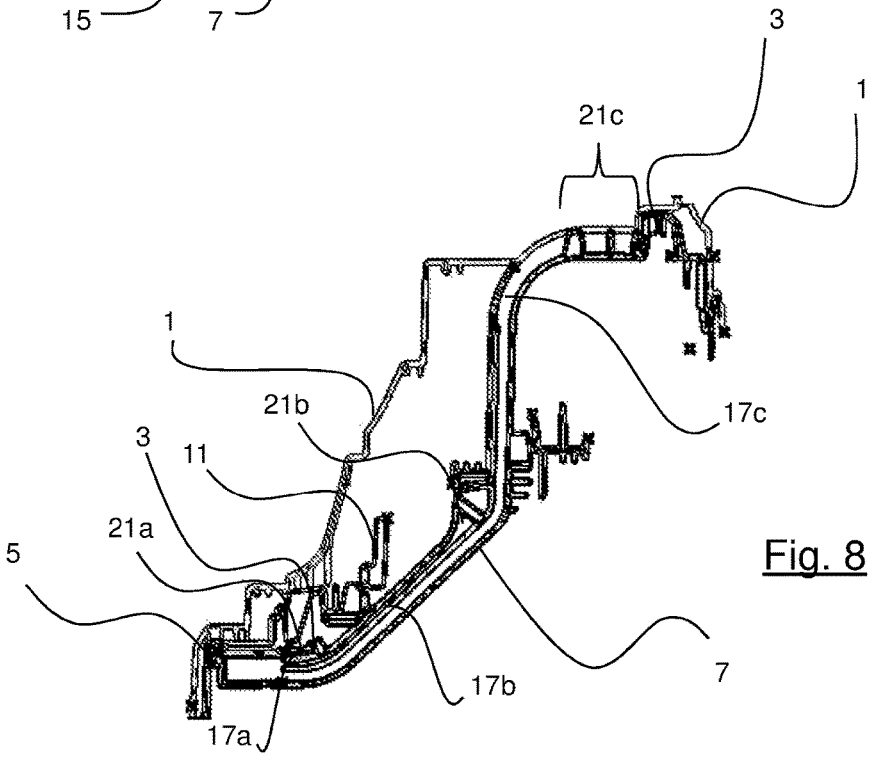
FIG. 8 shows a sectional view of the air duct of FIG. 7, which view is produced along the length of this air duct.

FIG. 8 is a sectional view of the air duct 7 of FIG. 7, which view is produced along the air duct length. This sectional view shows that the air duct 7 is divided into three sub-ducts 17*a*, 17*b*, 17*c*. Each sub-duct 17*a*, 17*b*, 17*c* is suitable for directly supplying a heat sink 3*a*, 3*b*, 3*c* with air flow via one of the outlets 21*a*, 21*b*, 21*c*. The heat sinks 3*a*, 3*b*, 3*c* are thus mounted in series along the air duct 7.

Figure 9:
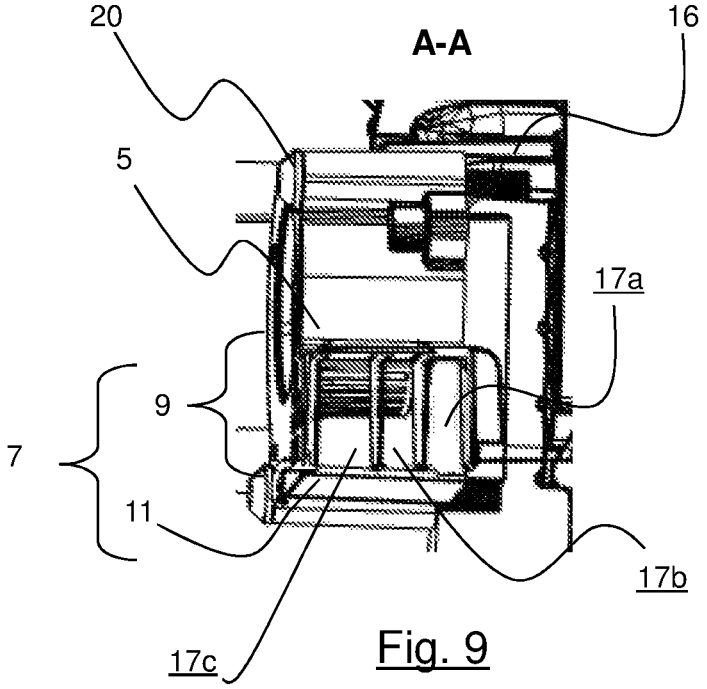
FIG. 9 shows a sectional view A-A of the duct of FIG. 7, which view is produced at the air outlet of the generator of the air flow.

FIG. 9 is a sectional view A-A of the air duct of FIG. 7, which view is produced at the air outlet 15 of the air flow generator 5. In this sectional view A-A, the air duct 7 is formed by the added open part 9 and by the closing structural element 11, in this case the optical unit 11.

The air duct 7 comprises the three sub-ducts 17*a*, 17*b*, 17*c* which substantially have a same flow area in a non-limiting embodiment. Thus, the air flow created by the air flow generator 5 is divided evenly between the three sub-ducts 17*a*, 17*b*, 17*c*. The three sub-ducts 17*a*, 17*b*, 17*c* will direct the air flow towards the three outlets 21*a*, 21*b*, 21*c* of the air duct 7 in order to cool the three light modules 2 via the associated heat sink 3*a*, 3*b* and 3*c* thereof.

Figure 10:
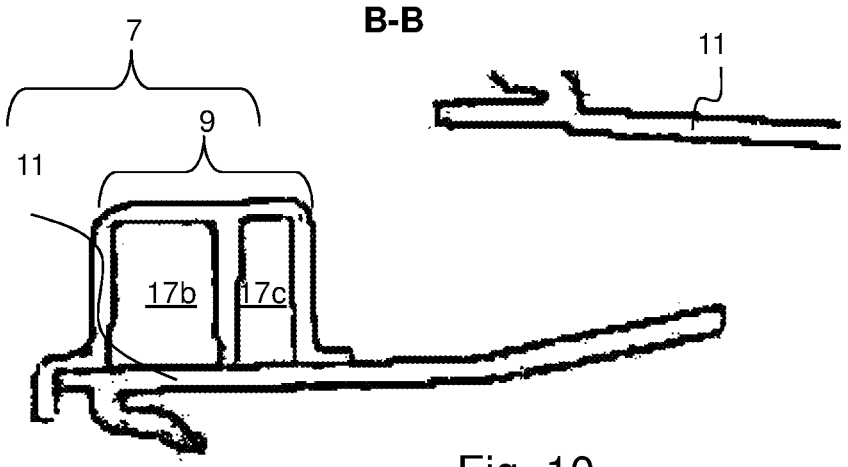
FIG. 10 shows a sectional view B-B of the duct of FIG. 7.

FIG. 10 is a sectional view B-B of the air duct of FIG. 7, which view is produced after the supply of air to the first heat sink 3*a*, i.e. after the sink closest to the generator of the air flow 5. In this sectional view B-B, the air duct 7 only comprises the two sub-ducts 17*b*, 17*c* which will direct the air flow towards the two outlets 21*b*, 21*c* of the air duct 7 in order to cool the two light modules furthest from the air flow generator 5. The sub-duct 17*a* cannot be seen in this section B-B since this section is downstream of the first light module 2.

Figure 11:
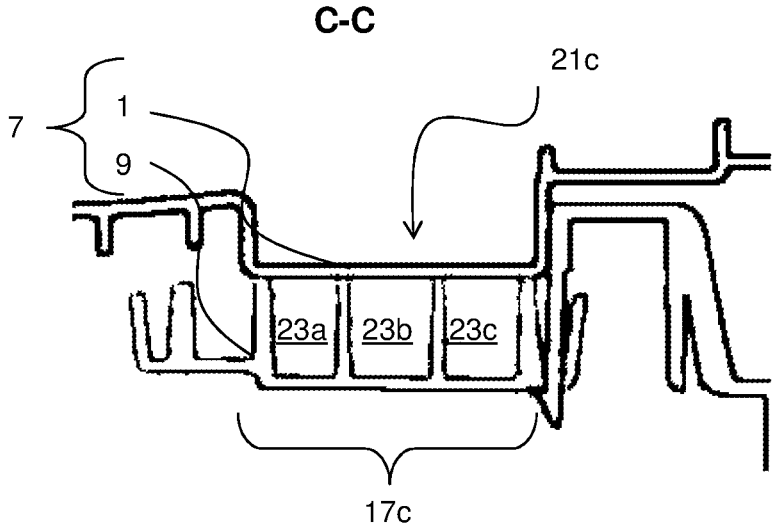
FIG. 11 shows a sectional view C-C of the duct of FIG. 7.

FIG. 11 is a sectional view C-C of the air duct of FIG. 7, which view is produced at the outlet 21*c* of this duct, namely at the third heat sink 3*c* furthest from the air flow generator 5.

The section of this outlet 21*c* is closed and the air duct 7 is defined by the side area 21*c*″ and by the optical unit 1, in particular the part 21*c*′. At this point, the air duct 7 only comprises a single duct 17*c* suitable for supplying the third heat sink 3*c* with air.

In a non-limiting embodiment, the sub-duct 17*c* is, in this case, divided into a plurality of channels 23*a*, 23*b*, 23*c*. The use of several channels at this outlet 21*c* allows a more uniform sweep of the fins of the last heat sink 3*c*. The action of the channels to guide the flows is thus limited to the outlet 21*c*. The term sub-duct is therefore clearly distinguished from the term channel. Indeed, a sub-duct starts at the outlet 15 of the air flow generator 5 and directs an air flow up to a heat sink 3*a*, 3*b*, 3*c*. A channel starts at the end of a sub-duct, which end is closest to a heat sink in order to uniformly distribute the air flow into the fins of a heat sink.

Of course, the description of the invention is not limited to the embodiments described above.

Thus, in a non-limiting embodiment, each sub-duct comprises a plurality of channels at a corresponding outlet.

Thus, in a non-limiting embodiment, the lighting device can include more than three light modules and therefore more than three sub-ducts supplying these light modules with air.

Thus, in another non-limiting embodiment, the closing structural element is the housing 1 alone. In this case, there is no optical unit 11.

Thus, in another non-limiting embodiment, the air duct 7 is formed by the added open part 9 and by two closing structural elements, namely the optical unit 11 and the housing 1. In this case, for example the part 21*c*′ is part of the housing 1 and no longer part of the optical unit 11. In this case, each closing structural element 1 and 11 is suitable for closing part of the added open part 9.

Thus, the described invention has, in particular, the following advantages:

the duct is defined partially by a structural element of the lighting device. The cost of producing the duct is thus lower since less added material is used to produce the duct;

the integration of the added part of the duct is facilitated. Indeed, this duct part exactly fits the complementary housing structural element;

fixing the added part of the duct via simple fixing means allows for installation and easy handling of this part added in the housing;

the duct includes a plurality of sub-ducts, each sub-duct being suitable for supplying a heat sink with air flow. Thus, using a single duct, it is possible to cool several light modules. The overall spatial requirement of the duct in the housing is then limited and an inconvenience for accessing the other lighting device functional members accommodated inside the housing, like the light modules, is prevented.

The invention claimed is:

1. Lighting device for motor vehicle, said lighting device comprising:

structural elements including a housing;

at least one light module accommodated inside said housing, comprising at least one light source cooperating with an optical surface, said light module being provided with a heat sink;

a generator of an air flow; and a single air duct suitable for cooperating with said generator of the air flow such as to direct said generated air flow towards the heat sink of said at least one light module, said air duct being formed by:

an open part added in the housing; and at least one structural closing element suitable for closing all or part of said added open part, wherein the lighting device comprises a series of N light modules and wherein the air duct is divided into N air sub-ducts, each air sub-duct supplying a light module of the series of the N light modules, respectively, with air, and the air sub-duct which supplies the light module furthest from the air flow generator with air includes an outlet directly connected to the housing so as to close the outlet.

2. Lighting device according to claim 1, wherein the structural closing element is an optical unit arranged in said housing and suitable for receiving said at least one light module.

3. Lighting device according to claim 1, wherein the structural closing element is said housing.

4. Lighting device according to claim 1, wherein the added part of the air duct is fixed by fixing means to the structural closing element.

5. Lighting device according to claim 4, wherein the fixing means are:

latching means; or sticking means; or screwing means.

6. Lighting device according to claim 1, wherein the generator of the air flow includes an air outlet and the air duct is connected directly to this air outlet.

7. Lighting device according to claim 1, wherein the air duct extends in the lighting device from the air flow generator and in a substantially longitudinal direction.

8. Lighting device according to claim 1, wherein the outlet of said air sub-duct is divided into a plurality of channels.

9. Lighting device according to claim 1, wherein the light source is a semi-conducting emitting chip.

10. Lighting device according to claim 1, wherein the structural element forming part of the air duct is made from plastic.

11. Lighting device according to claim 1, wherein said lighting device is a headlight.

12. Lighting device for motor vehicle, said lighting device comprising:

a housing;

at least one light module accommodated inside said housing, comprising at least one light source cooperating with an optical surface, a heat sink arranged to extract heat from the at least one light module;

a generator of an air flow; and a single air duct suitable for cooperating with said generator of the air flow such as to direct said generated air flow towards the heat sink of said at least one light module, said air duct being formed by:

an open part added in the housing; and at least one closing element suitable for closing all or part of said added open part, wherein the air duct includes at least one outlet which opens directly onto the heat sink of said at least one light module, and the air duct has an outlet which is directly connected to the housing so as to close the outlet.

* * * * *